US005693398A

United States Patent [19]

Granger

[11] Patent Number: 5,693,398

[45] Date of Patent: Dec. 2, 1997

[54] VERSATILE BEACH TOWEL

[76] Inventor: Robert J. Granger, 7 Lindberg Ct., Northport, N.Y. 11768

[21] Appl. No.: 674,528

[22] Filed: Jul. 2, 1996

[51] Int. Cl.[6] ..... B32B 3/06; B32B 3/08

[52] U.S. Cl. ..... 428/66.7; 428/99; 428/100; 428/101; 428/193; 5/417; 383/4; 383/72

[58] Field of Search ..... 428/100, 80, 64.1, 428/99, 66.7, 193, 101; 5/417, 419; 383/4, 72

[56] References Cited

U.S. PATENT DOCUMENTS 4,154,323 5/1979 Sneider ..... 5/417
4,634,618 1/1987 Greer et al. ..... 5/417
4,794,029 12/1988 Tenant et al. ..... 5/417
5,481,767 1/1996 Lewis ..... 5/417

*Primary Examiner*—Alexander Thomas
*Attorney, Agent, or Firm*—Michael I. Kroll

[57] ABSTRACT

A versatile beach towel (10) comprising a circular piece of absorbent fabric (12). A binding (14) is attached to a circumferential edge (16) of the circular piece of absorbent fabric (12). The binding (14) has a hollow passageway (18) therethrough. A drawstring (20) extends through the hollow passageway (18) in the binding (14). When the drawstring (20) is pulled tight, the binding (14) will close up and the circular piece of absorbent fabric (12) will turn into a pouch (22) for holding objects therein.

1 Claim, 2 Drawing Sheets

VERSATILE BEACH TOWEL

BACKGROUND OF THE INVENTION

1. Field of the Invention

The instant invention relates generally to towels and more specifically it relates to a versatile beach towel.

2. Description of the Prior Art

Numerous towels have been provided in prior art that are made out of pieces of absorbent cloth used for wiping or drying some things that are wet. While these units may be suitable for the particular purpose to which they address, they would not be as suitable for the purposes of the present invention as heretofore described.

SUMMARY OF THE INVENTION

A primary object of the present invention is to provide a versatile beach towel that will overcome the shortcomings of the prior art devices.

Another object is to provide a versatile beach towel that is a circular piece of absorbent fabric with a drawstring extending through a binding at the circumferential edge thereof, so that when the drawstring is pulled tight through the binding, the absorbent cloth will close up to become a pouch for holding objects therein.

An additional object is to provide a versatile beach towel that contains a holding component, which can be attached in a removable manner to a portion of the binding, so that when the beach towel becomes wet it can be stored in the holding component, and when the holding component is filled with sand it will act as an anchor to keep the beach towel on the sand during windy conditions.

A further object is to provide a versatile beach towel that is simple and easy to use.

A still further object is to provide a versatile beach towel that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 6:
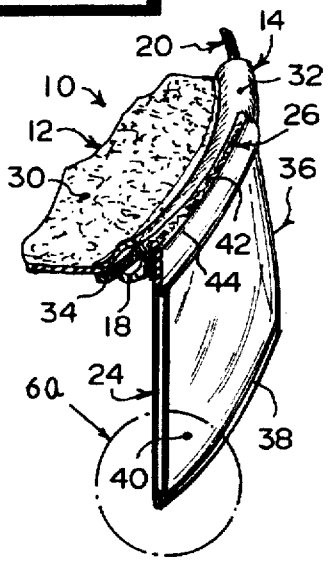
FIG. 6 is an enlarged perspective view of an area indicated by arrow 6 in FIG. 5.
Figure 6A:
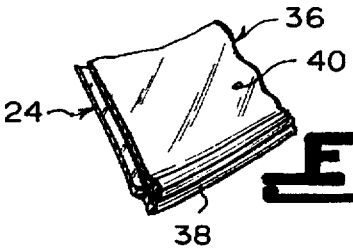

FIG. **6*a* is a still further enlarged perspective view of an area indicated by arrow 6*a* in FIG. 6**.

Figure 7:
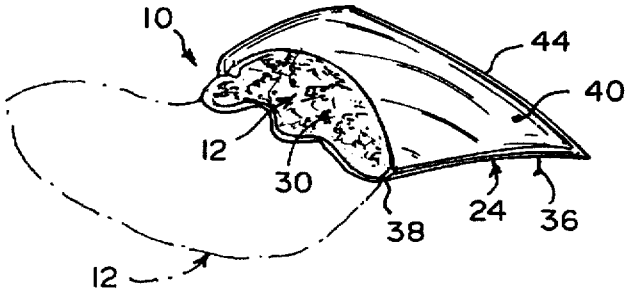

FIG. 7 is a perspective view of the retaining component, showing the beach towel, when wet, being inserted into the retaining component.

Figure 8:
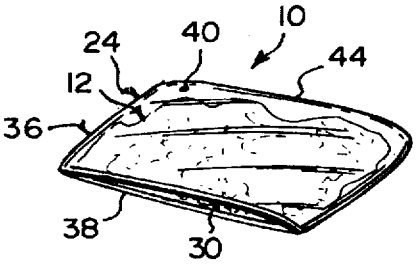

FIG. 8 is a perspective view similar to FIG. 7, showing the wet beach towel fully inserted into the retaining component.

Similar reference characters denote corresponding features consistently throughout the attached drawings.

DETAILED DESCRIPTION OF THE PREFERRED EMBODIMENTS

Figure 1:
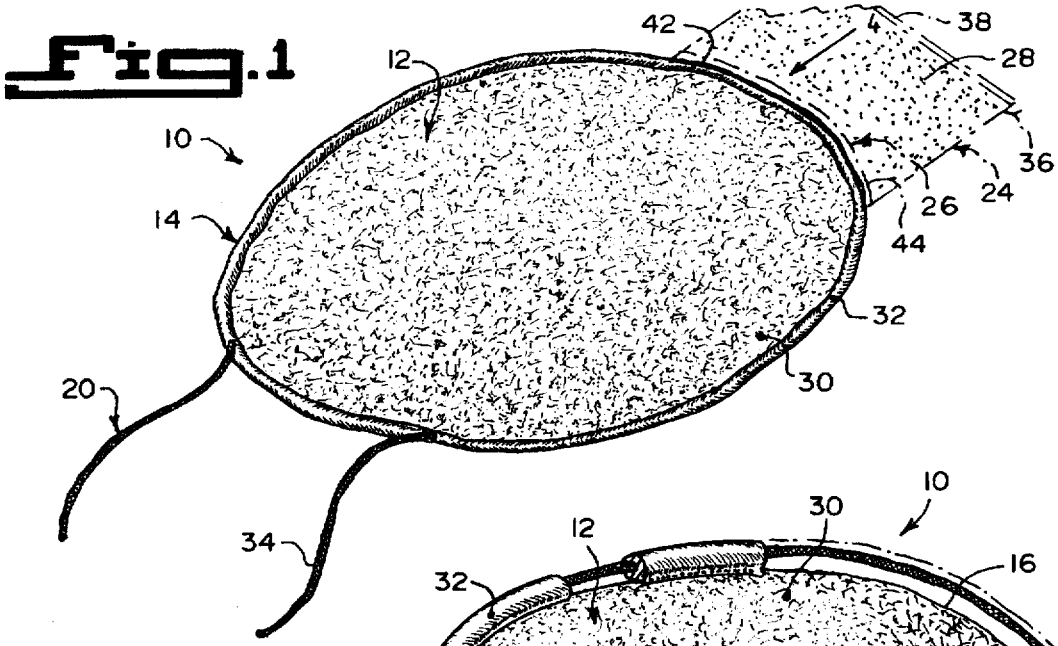
FIG. 1 is a perspective view of the instant invention in a flat state, showing in phantom, the retaining component filled with sand and attached to the circumference hem.
Figure 2:
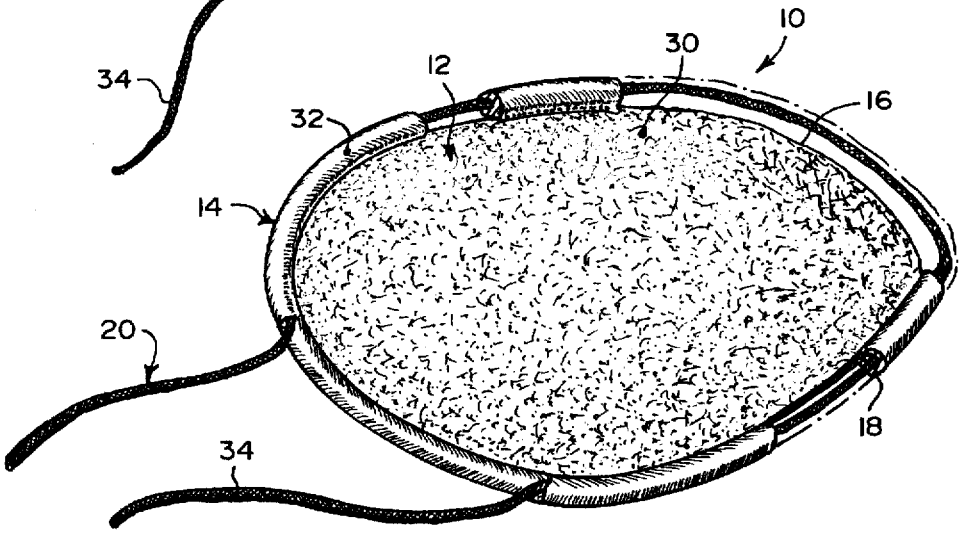
FIG. 2 is a perspective view of the instant invention in the flat state, showing a portion of the circumference hem broken away.
Figure 3:
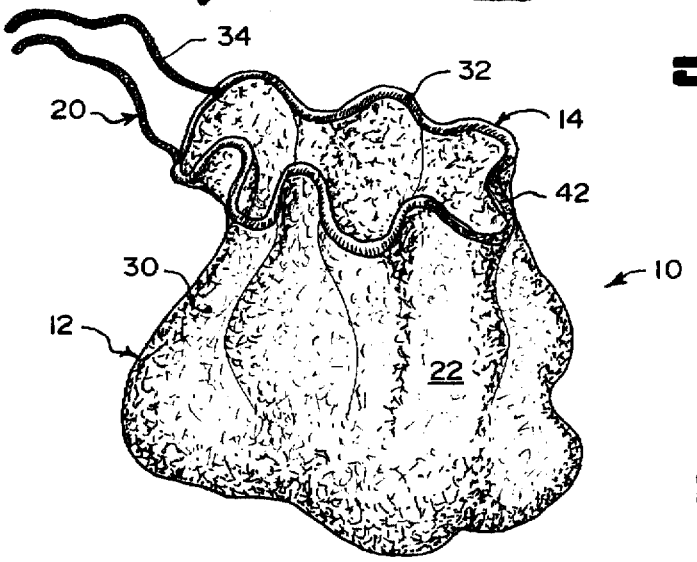
FIG. 3 is a perspective view of the instant invention in a pouch state with the drawstring pulled tight.
Figure 4:
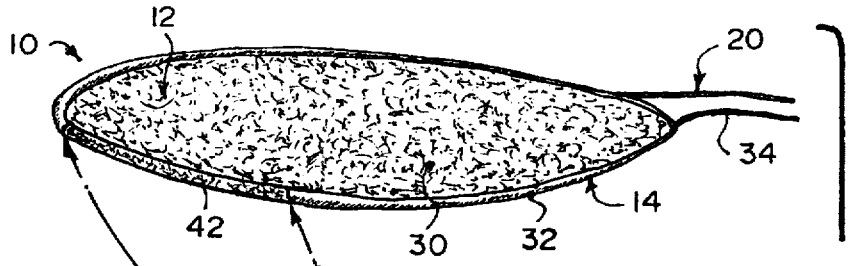
FIG. 4 is a perspective view taken in the direction of arrow 4 in FIG. 1, showing the retaining component ready to be attached to the circumference hem.
Figure 4:
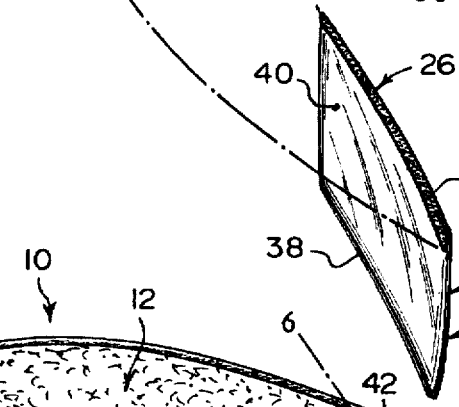
Figure 5:
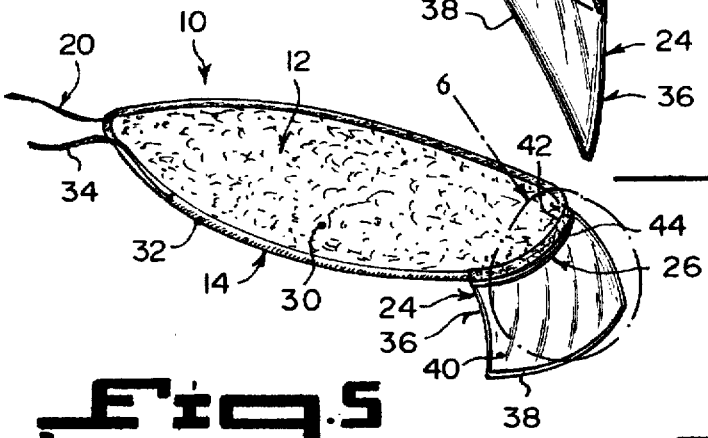
FIG. 5 is a perspective view of the instant invention in the flat state, showing the retaining component attached to the circumference hem.

Turning now descriptively to the drawings, in which similar reference characters denote similar elements throughout the several views, FIGS. 1 through 8, illustrate a versatile beach towel 10 comprising a circular piece of absorbent fabric 12. A binding 14 is attached to a circumferential edge 16 of the circular piece of absorbent fabric 12. .The binding 14 has a hollow passageway 18 therethrough. A drawstring 20 extends through the hollow passageway 18 in the binding 14. When the drawstring 20 is pulled tight, the binding 14 will close up and the circular piece of absorbent fabric 12 will turn into a pouch 22 for holding objects therein, as shown in FIG. 3.

A component 24 is for storing the versatile beach towel 10 in a folded up state, so that the versatile beach towel 10 can be maintained in a safe manner, especially when wet. A structure 26 is for retaining the storing component 24 to a portion of the binding 14 in a removable manner. When the storing component 24 is filled with a weighted material 28 such as sand, the storing component 24 will act as an anchor to keep the versatile beach towel 10 down on the beach as a beach blanket during windy conditions (see FIG. 1).

The circular piece of absorbent fabric 12 is fabricated out of a terry cloth material 30. The binding 14 is fabricated out of a flexible strip of material 32 to protect, reinforce and ornamentally cover the circumferential edge 16 of the circular piece of absorbent fabric 12.

The drawstring 20 is an elongated cord 34, which runs out through the hollow passageway 18 in the binding 14. The storing component 24 is a bag 36, so that when the versatile beach towel 10 is folded up it can be inserted into the bag 36.

The bag 36 includes a closeable seal end 38. The closeable seal end 38 can be sealed shut after the versatile beach towel 10 is inserted into the bag 36. The bag 36 is fabricated out of a thin strong liquid resistant plastic material 40.

The retaining structure 26 consists of a first VELCRO hook or loop fastener strip 42 affixed to the binding 14. A second VELCRO hook or loop fastener strip 44 is secured to the storing component 24. The first VELCRO strip 42 can mate with the second VELCRO strip 44, to hold the storing component 24 to the binding 14.

OPERATION OF THE INVENTION

To use the versatile beach towel 10, the following steps should be taken:

1. Keep the circular piece of absorbent fabric 12 in a flat open state, so that it can be used as a normal beach towel to dry water off a person.

2. Pull the drawstring 20 tight, so that the binding 14 will now close up and the circular piece of absorbent fabric 12 will turn into the pouch 22 for holding objects therein.
3. Place the weight material 28, such as sand, into the storing component 24.
4. Allow the first VELCRO strip 42 on the binding 14 to mate with the second VELCRO strip 44 on the storing component 24, so that the weighted material 28 in the storing component 24 will act as an anchor to keep the versatile beach towel 10 down on the beach as a beach blanket during windy conditions.
5. Insert the versatile beach towel 10 in a folded up state into the storing component 24, so that when wet the versatile beach towel 10 can be safely maintained.

LIST OF REFERENCE NUMBERS

10 versatile beach towel
12 circular piece of absorbent fabric of 10
14 binding on 16
16 circumferential edge of 12
18 hollow passageway in 14
20 drawstring in 18
22 pouch for 10
24 storing component of 10
26 retaining structure of 10 for 24
28 weighted material (sand)
30 terry cloth material for 12
32 flexible strip of material for 14
34 elongated cord for 20
36 bag for 24
38 closeable seal end on 36
40 thin strong liquid resistant plastic material of 36
42 first VELCRO strip of 26 on 14
44 second VELCRO strip of 26 on 24

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A versatile beach towel comprising:

a) a circular piece of absorbent fabric;

b) a binding attached to a circumferential edge of said circular piece of absorbent fabric, said binding having a hollow and substantially fully enclosed passageway therethrough;

c) a drawstring having a first end and a second end extending through said hollow passageway in said binding with said first and second ends extending out of said passageway permitting said drawstring to be pulled tight, said binding closing up and said circular piece of absorbent fabric turning into a pouch for holding objects therein; and d) means for storing said versatile beach towel in a folded up state comprising a bag fabricated out of a thin strong liquid resistant plastic material having an open end with a closeable seal and a permanently closed end, said closed end having a hook or loop fastener on the outside of said bag, and a mating hook or loop fastener affixed to said binding so that said bag is removably attached to said towel with the open end of said bag facing away from said towel, said bag being capable of being filled with weighted material for keeping said towel down during windy conditions.

* * * * *